US012490834B2

(12) United States Patent
Shan et al.

(10) Patent No.: US 12,490,834 B2
(45) Date of Patent: Dec. 9, 2025

(54) FOLDABLE ELECTRIC BED

(71) Applicant: Keeson Technology Corporation Limited, Zhejiang (CN)

(72) Inventors: Huafeng Shan, Zhejiang (CN); Chuanxiang Ji, Zhejiang (CN); Xiang Nie, Zhejiang (CN); Jian Wang, Zhejiang (CN)

(73) Assignee: Keeson Technology Corporation Limited, Jiaxing (CN)

( * ) Notice: Subject to any disclaimer, the term of this patent is extended or adjusted under 35 U.S.C. 154(b) by 753 days.

(21) Appl. No.: 17/642,227

(22) PCT Filed: Mar. 23, 2020

(86) PCT No.: PCT/CN2020/080601

§ 371 (c)(1),
(2) Date: Mar. 10, 2022

(87) PCT Pub. No.: WO2021/068458

PCT Pub. Date: Apr. 15, 2021

(65) Prior Publication Data

US 2022/0312980 A1 Oct. 6, 2022

(30) Foreign Application Priority Data

Oct. 9, 2019 (CN) ..... 201910954642.8

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 19/12; A47C 17/86
(Continued)

(56) References Cited

U.S. PATENT DOCUMENTS 3,281,141 A * 10/1966 Smiley ..... A61G 13/00 5/618
6,276,011 B1 * 8/2001 Antinori ..... A47C 20/041 5/613

(Continued)

FOREIGN PATENT DOCUMENTS

CN 109717660 A 5/2019
CN 209152797 U 7/2019

(Continued)

OTHER PUBLICATIONS

Examination Report No. 2 of Australian Standard Patent Application No. 2020363581 issued on Dec. 19, 2023.

(Continued)

*Primary Examiner* — Amber R Anderson
*Assistant Examiner* — Luke Hall

(57) ABSTRACT

A foldable electric bed includes an upper bed body, a lower bed body and a split-type fixing part. The two ends of the split-type fixing part are fixedly connected to the outer wall on the same side of the upper bed body and the lower bed body, respectively; the upper bed body may be folded at the split-type fixing part relative to the lower bed body; the split-type fixing part includes a first fixing piece and a second fixing piece; the first fixing piece and the second fixing piece are detachably and fixedly connected; the first fixing piece is disposed on the outer wall of the upper bed body; and the second fixing piece is disposed on the outer wall of the lower bed body.

6 Claims, 3 Drawing Sheets

(58) Field of Classification Search
USPC ..... 5/616
See application file for complete search history.

(56) References Cited

U.S. PATENT DOCUMENTS

| | | | | |
|---|---|---|---|---|
| 6,907,631 | B2 * | 6/2005 | Heaton | A47C 20/08 5/616 |
| 7,036,165 | B2 * | 5/2006 | Weinman | A61G 7/015 5/617 |
| 9,808,093 | B2 * | 11/2017 | Rawls-Meehan | A47C 20/04 |
| 10,463,163 | B1 * | 11/2019 | Aramli | A47C 21/026 |
| 10,786,087 | B2 * | 9/2020 | Huang | A47C 20/10 |
| D907,395 | S * | 1/2021 | Li | D6/392 |
| 10,912,390 | B1 * | 2/2021 | Chung | A47C 19/04 |
| 10,912,391 | B2 * | 2/2021 | Wang | A61G 7/0506 |
| 11,083,304 | B2 * | 8/2021 | Ji | A47C 20/04 |
| 2008/0127415 | A1 * | 6/2008 | Ruschke | A61G 7/0516 5/428 |
| 2014/0041121 | A1 * | 2/2014 | Shan | A47C 21/006 5/618 |
| 2014/0259409 | A1 * | 9/2014 | Shih | A61G 7/002 5/600 |
| 2015/0067965 | A1 * | 3/2015 | Xu | A61G 7/018 5/616 |
| 2017/0295943 | A1 * | 10/2017 | Barr | A47C 19/025 |
| 2017/0347806 | A1 * | 12/2017 | Shih | A47C 20/041 |
| 2017/0360209 | A1 * | 12/2017 | Zhou | A47C 20/041 |
| 2018/0103768 | A1 * | 4/2018 | Nava | A47C 20/041 |
| 2018/0125249 | A1 * | 5/2018 | Chung | A47C 19/021 |
| 2018/0125252 | A1 * | 5/2018 | Chung | A47C 20/04 |
| 2018/0235373 | A1 * | 8/2018 | Tsai | A47C 20/08 |
| 2019/0125089 | A1 * | 5/2019 | Aramli | A47C 19/021 |
| 2019/0239653 | A1 * | 8/2019 | Shan | A47C 20/041 |
| 2020/0187662 | A1 * | 6/2020 | Zeng | A47C 19/122 |
| 2020/0214462 | A1 * | 7/2020 | Wang | A47C 19/122 |
| 2020/0214463 | A1 * | 7/2020 | Xie | A47C 20/041 |
| 2021/0052085 | A1 * | 2/2021 | Wang | A47C 31/005 |
| 2021/0177154 | A1 * | 6/2021 | Shan | A61G 7/018 |

FOREIGN PATENT DOCUMENTS

| | | |
|---|---|---|
| EP | 3505014 A1 | 7/2019 |
| GB | 378221 A | 8/1932 |

OTHER PUBLICATIONS

International Search Report of PCT Patent Application No. PCT/CN2020/080601 issued on Jun. 24, 2020.

Examination Report of Counterpart Australian Patent Application No. 2020363581 Issued on Aug. 3, 2023.

* cited by examiner

FOLDABLE ELECTRIC BED

FIELD OF THE INVENTION

The present disclosure relates to the technical field of mechanics, and in particular, to a foldable electric bed.

BACKGROUND OF THE INVENTION

With the improvement of living conditions, people have increasingly high requirements for beds. Electric beds can meet many new requirements that people put forward to the beds, but the electric beds have a relatively more complex structure than conventional beds. Previously, the electric beds are mostly transported as disassembled components to a location of a user and installed at the location of the user, and meanwhile a volume and weight of the electric beds are relatively larger than conventional beds, which is not convenient for installation and transportation.

SUMMARY OF THE INVENTION

The disclosure provides a foldable electric bed, so as to solve the technical problem in existing technologies that it is not convenient to install and transport electric beds.

For this purpose, the disclosure provides a foldable electric bed. The foldable electric bed includes an upper bed body, a lower bed body, and a split-type fixing part. Herein, two ends of the split-type fixing part are fixedly connected to an outer wall of the upper bed body and an outer wall of the lower bed body on the same side respectively, and the upper bed body is foldable at the split-type fixing part relative to the lower bed body. The split-type fixing part includes a first fixing piece and a second fixing piece. Herein, the first fixing piece and the second fixing piece are detachably and fixedly connected, the first fixing piece being disposed on the outer wall of the upper bed body, the second fixing piece being disposed on the outer wall of the lower bed body.

Further, the upper bed body includes a first load-bearing part, a first flipping mechanism, a first sliding mechanism, a first limiting mechanism, and an upper frame. The lower bed body includes a second load-bearing part, a second flipping mechanism, a second sliding mechanism, a second limiting mechanism, and a lower frame. Herein, the first load-bearing part is disposed on a top of the upper frame; the first flipping mechanism and the first sliding mechanism are both located between the first load-bearing part and the upper frame; two ends of the first flipping mechanism are respectively pivotably connected to a head portion of the first load-bearing part and the upper frame; the first sliding mechanism is fixedly connected to the first load-bearing part and a tail portion of the upper frame so that the first load-bearing part is slidable relative to the upper frame; and two ends of the first limiting mechanism are respectively pivotably connected to the first load-bearing part and a head portion of the upper frame. The second load-bearing part is disposed on a top of the lower frame; the second flipping mechanism and the second sliding mechanism are both located between the second load-bearing part and the lower frame; two ends of the second flipping mechanism are respectively pivotably connected to the second load-bearing part and a head portion of the lower frame; the second sliding mechanism are fixedly connected to the second load-bearing part and the lower frame respectively so that the second load-bearing part is slidable relative to the lower frame; and two ends of the second limiting mechanism are respectively pivotably connected to a tail portion of the first load-bearing part and the second sliding mechanism. The first sliding mechanism and the second sliding mechanism are pivotably connected at a junction of the upper bed body and the lower bed body.

Further, the first load-bearing part includes a first load-bearing component and a second load-bearing component. The second load-bearing part includes a third load-bearing component, a fourth load-bearing component, and a fifth load-bearing component. The first load-bearing component and the second load-bearing component are pivotably connected at a junction. The third load-bearing component, the fourth load-bearing component, and the fifth load-bearing component are successively pivotably connected at junctions.

Further, the upper frame includes a first supporting element, a second supporting element, a third supporting element, a fourth supporting element, and a fifth supporting element. The lower frame includes a sixth supporting element, a seventh supporting element, an eighth supporting element, a ninth supporting element, and a tenth supporting element. Herein, the first supporting element and the second supporting element are parallel; the third supporting element, the fourth supporting element, and the fifth supporting element are parallel to one another; two ends of the first supporting element and two ends of the second supporting element are respectively perpendicular to and connected to two ends of the third supporting element and two ends of the fourth supporting element; and two ends of the fifth supporting element are respectively perpendicular to and connected to the first supporting element and the second supporting element, and the fifth supporting element is located below the first load-bearing component. The sixth supporting element and the seventh supporting element are parallel; the eighth supporting element, the ninth supporting element, and the tenth supporting element are parallel to one another; two ends of the sixth supporting element and two ends of the seventh supporting element are respectively perpendicular to and connected to two ends of the eighth supporting element and two ends of the ninth supporting element; and two ends of the tenth supporting element are respectively perpendicular to and connected to the sixth supporting element and the seventh supporting element, and the tenth supporting element is located below the fourth load-bearing component.

Further, the first sliding mechanism includes a first rail, a first pulley set, and a first pulley seat. Herein, the first rail is disposed at an inner side wall of the first supporting element and an inner side wall of the second supporting element; the first pulley set and the first pulley seat are pivotably connected; the first pulley seat and the second supporting element are fixedly connected; and the first pulley set is slidable on the first rail. The second sliding mechanism includes a second rail, a second pulley set, a second pulley seat, a third rail, a third pulley set, and a third pulley seat. Herein, the second rail is disposed at an inner side wall of the sixth supporting element and an inner side wall of the seventh supporting element; the second pulley set and the second pulley seat are pivotably connected; the second pulley seat and the third supporting element are fixedly connected; and the second pulley set is slidable on the second rail. The third rail is perpendicular to and fixedly connected to a middle portion of the ninth supporting element and extends towards the tenth supporting element; a top surface of the third rail is flush with a top surface of the lower frame; the third pulley set and the third pulley seat are pivotably connected; the third pulley seat and the fifth supporting element are fixedly connected; and the third pulley set is slidable on the second rail. The first pulley seat and the second pulley seat are pivotably connected at a junction of the upper frame and the lower frame.

Further, the second sliding mechanism further includes a fourth rail, a fourth pulley set, and a fourth pulley seat. Herein, the fourth rail is disposed at an inner side wall of the sixth supporting element and an inner side wall of the seventh supporting element; the fourth pulley set and the fourth pulley seat are pivotably connected; the fourth pulley seat is fixedly connected to a head portion of the fifth supporting element, and the fourth pulley set is slidable on the fourth rail. Two ends of the second limiting mechanism are respectively pivotably connected to the fourth pulley seat and the fifth load-bearing component.

Further, two ends of the first flipping mechanism are respectively perpendicular to and pivotably connected to a head portion of the first load-bearing part and a middle portion of the fifth supporting element, and the second flipping mechanism includes a driving motor and a scissor-type bracket. Herein, one end of the driving motor is perpendicular to and pivotably connected to a middle portion of the seventh supporting element; and the scissor-type bracket includes a first supporting bracket and a second supporting bracket. Two ends of the first supporting bracket are respectively pivotably connected to a tail portion of the fourth load-bearing component and the other end of the driving motor; and two ends of the second supporting bracket are respectively pivotably connected to a middle portion of the tenth supporting element and a middle portion of the first supporting bracket.

Further, a thickness at a center of a pivotable junction of the fourth load-bearing component and the fifth load-bearing component is less than a thickness at an extension thereof, and the thickness at the extension of the pivotable junction of the fourth load-bearing component and the fifth load-bearing component is less than a thickness of the fourth load-bearing component and a thickness of the fifth load-bearing component.

Further, the fourth load-bearing component further includes a reinforcing rod, a fool-proofing element, and a shock absorbing element. Herein, the reinforcing rod is disposed on the third load-bearing component; the fool-proofing element and the shock absorbing element are both disposed on the reinforcing rod; the fool-proofing element is located right above the driving motor and extends towards the driving motor; and the shock absorbing element is located right above the eighth supporting element and extends to a top of the eighth supporting element.

Further, the first load-bearing component further includes a multifunction socket. Herein, the multifunction socket is disposed on a lower surface of the first load-bearing component.

According to the foldable electric bed in the disclosure, a size of the electric bed is reduced by folding a bed body, so as to meet requirements of transportation and fast installation.

BRIEF DESCRIPTION OF THE DRAWINGS

Other features, objectives, and advantages of the disclosure will become more evident by reading the detailed description of non-limiting embodiments made with reference to the following accompanying drawings.

LIST OF REFERENCE NUMERALS

1—upper bed body, 101—head portion, 201—tail portion, 11—first load-bearing part, 12—first flipping mechanism, 13—first sliding mechanism, 131—first pulley set, 132—first pulley seat, 14—first limiting mechanism, 15—upper frame, 111—first load-bearing component, 112—second load-bearing component, 151—first supporting element, 152—second supporting element, 153—third supporting element, 154—fourth supporting element, 155—fifth supporting element;

2—lower bed body, 21—second load-bearing part, 22—second flipping mechanism, 23—second sliding mechanism, 24—second limiting mechanism, 25—lower frame;

211—third load-bearing component, 212—fourth load-bearing component, 213—fifth load-bearing component;

221—driving motor, 222—first supporting bracket, 223—second supporting bracket, 231—second pulley set, 232—second pulley seat, 233—third rail, 234—third pulley seat, 235—fourth pulley set, 236—fourth pulley seat; 237—second rail;

251—sixth supporting element, 252—seventh supporting element, 253—eighth supporting element, 254—ninth supporting element, 255—tenth supporting element;

1111—multifunction socket, 2121—reinforcing rod, 2122—fool-proofing element, 2123—shock absorbing element;

3—split-type fixing part, 31—first fixing piece, 32—second fixing piece.

DETAILED DESCRIPTION OF THE EMBODIMENTS

The disclosure is further described in detail with reference to the accompanying drawings.

Figure 1:
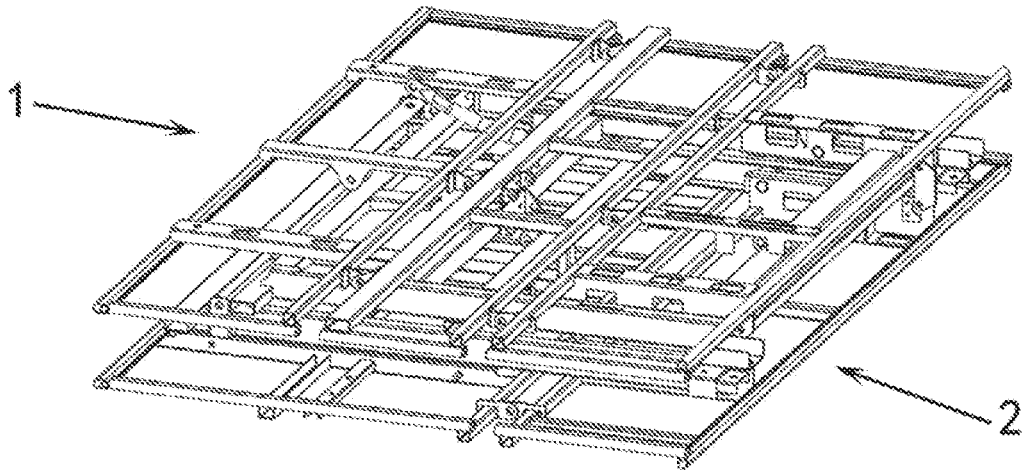
FIG. 1 schematically shows a folded view of a foldable electric bed according to an embodiment of the disclosure.
Figure 2:
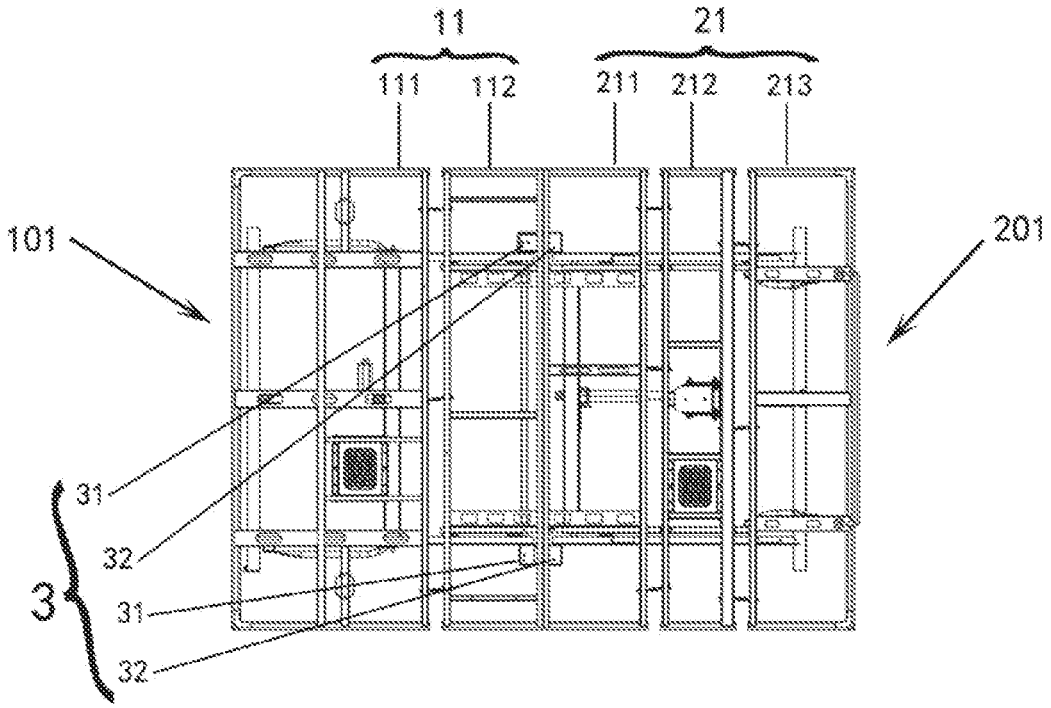
FIG. 2 is a top view of a foldable electric bed according to an embodiment of the disclosure.

FIG. 1 schematically shows a folded view of a foldable electric bed according to an embodiment of the disclosure. FIG. 2 is a top view of a foldable electric bed according to an embodiment of the disclosure. As shown in FIG. 1 and FIG. 2, the foldable electric bed includes an upper bed body 1, a lower bed body 2, and a split-type fixing part 3. Herein, two ends of the split-type fixing part 3 are fixedly connected to an outer wall of the upper bed body 1 and an outer wall of the lower bed body 2 on the same side respectively, and the upper bed body 1 is foldable at the split-type fixing part 3 relative to the lower bed body 2. The split-type fixing part 3 includes a first fixing piece 31 and a second fixing piece 32. Herein, the first fixing piece 31 and the second fixing piece 32 are detachably and fixedly connected, the first fixing piece 31 being disposed on the outer wall of the upper bed body 1, the second fixing piece 32 is disposed on the outer wall of the lower bed body 2.

UPS is the most commonly used express in the USA, and a charging standard of this express is very strict. This express is very economical when a size and weight of a package meet requirements, and thus has a great competition advantage for terminal marketing. The UPS standard is that an outer package size=length+(width+height)×2<3940 millimeter, and the gross weight of an entire bed is less than 68

KG. To meet this standard, the electric bed with a size of 1524 millimeter×2032 millimeter must be made to have a folded structure.

When the first fixing piece 31 and the second fixing piece 32 are not connected, the upper bed body 1 and the lower bed body 2 may be stacked with each other, and the upper bed body 1 and the lower bed body 2 may also be pivotably connected to each another at a junction so as to achieve foldable connection therebetween. A connecting element may be additionally disposed. Two ends of the connecting element are respectively pivotably connected to the upper bed body 1 and the lower bed body 2, and a length of the connecting element is used for providing a degree of freedom for folding of the bed body. The upper bed body 1 and the lower bed body 2 are rotated in opposite directions using a pivotable junction 4 therebetween as a rotation axis and then are folded to make the upper bed body 1 and the lower bed body 2 fully folded, so that a length of the bed body in a folding direction is reduced to 50% of an original length. Moreover, the upper bed body 1 and the lower bed body 2 are fully folded to control a thickness of a folded bed body, so that requirements for the package size of the UPS are met.

When folding is not performed on the electric bed, the split-type fixing part 3 reinforces connection strength between the upper bed body 1 and the lower bed body 2 through connection between the first fixing piece 31 and the second fixing piece 32 to prevent the junction to collapse downwards when the user is using the electric bed, so that the electric bed is safer and more reliable. The first fixing piece 31 and the second fixing piece 32 may be fixed by cooperation of a bolt and a screw nut therebetween. The split-type fixing part 3 may also be fixedly connected by mounting a bed leg, which both reinforces the connection strength between the upper bed body 1 and the lower bed body 2 and provides more reliable support for a middle portion of the bed body, so that stability of the entire bed body when used is improved. When folding is to be performed on the electric bed, it is only required to separate the first fixing piece 31 and the second fixing piece 32 so as to perform folding, which is simple, fast, and convenient.

Besides, by means of the foldable connection between the upper bed body 1 and the lower bed body 2 and cooperation of the split-type fixing part 3, after assembling of a main body is completed in the factory, the electric bed is folded and packed, which can reduce the package size of the bed body so as to provide convenience for packing and transportation. When the electric bed is to be used, it is only required to unfold the folded bed body and fix the relative position between the first fixing piece 31 and the second fixing piece 32 to limit folding between the upper bed body 1 and the lower bed body 2, which is easy and convenient for mounting and is labor-saving.

Figure 3:
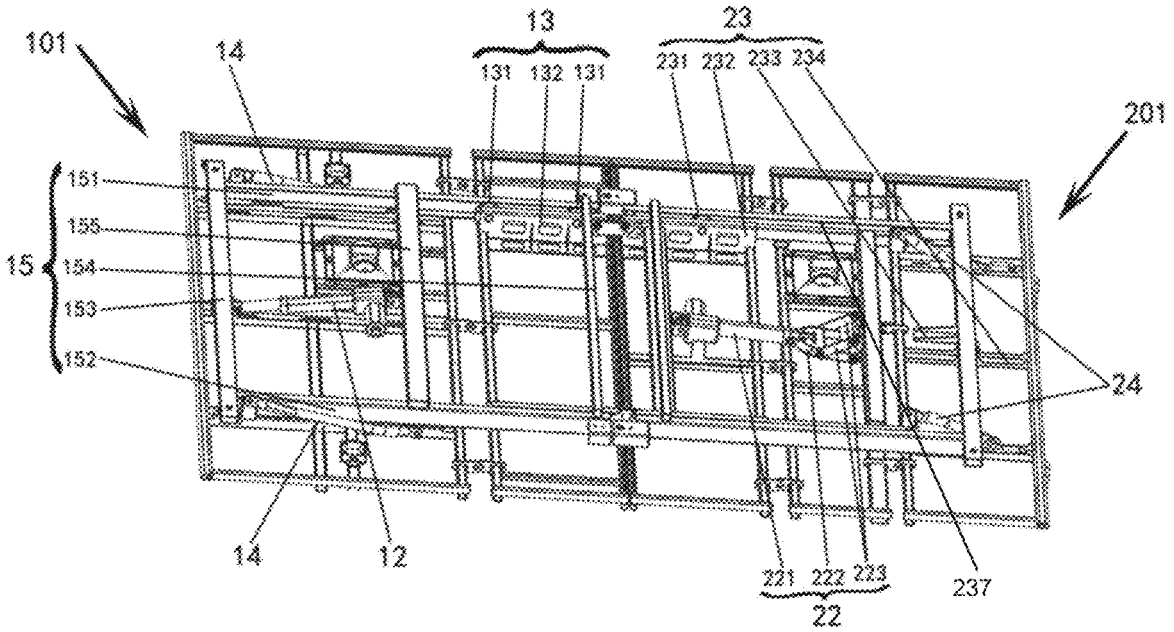
FIG. 3 is a first bottom view of a foldable electric bed according to an embodiment of the disclosure.

Further, FIG. 3 is a first bottom view of a foldable electric bed according to an embodiment of the disclosure. As shown in FIG. 2 and FIG. 3, the upper bed body 1 includes a first load-bearing part 11, a first flipping mechanism 12, a first sliding mechanism 13, a first limiting mechanism 14, and an upper frame 15. The lower bed body 2 includes a second load-bearing part 21, a second flipping mechanism 22, a second sliding mechanism 23, a second limiting mechanism 24, and a lower frame 25. Herein, the first load-bearing part 11 is disposed on a top of the upper frame 15. The first flipping mechanism 12 and the first sliding mechanism are both located between the first load-bearing part 11 and the upper frame 15. Two ends of the first flipping mechanism 12 are respectively pivotably connected to a head portion 101 of the first load-bearing part 11 and the upper frame 15. The first sliding mechanism is fixedly connected to the first load-bearing part 11 and a tail portion 201 of the upper frame 15 respectively, so that the first load-bearing part 11 is slidable relative to the upper frame 15. Two ends of the first limiting mechanism 14 are respectively pivotably connected to the first load-bearing part 11 and a head portion 101 of the upper frame 15. The second load-bearing part 21 is disposed on a top of the lower frame 25. The second flipping mechanism 22 and the second sliding mechanism are both located between the second load-bearing part 21 and the lower frame 25. Two ends of the second flipping mechanism 22 are respectively pivotably connected to the second load-bearing part 21 and a head portion 101 of the lower frame 25. The second sliding mechanism is fixedly connected to the second load-bearing part 21 and the lower frame 25 respectively, so that the second load-bearing part 21 is slidable relative to the lower frame 25. Two ends of the second limiting mechanism 24 are respectively pivotably connected to a tail portion 201 of the first load-bearing part 11 and the second sliding mechanism 23. The first sliding mechanism 13 and the second sliding mechanism 23 are pivotably connected at a junction of the upper bed body 1 and the lower bed body 2.

When the first flipping mechanism 12 operates, the first flipping mechanism 12 drives the first load-bearing part 11 in whole or in part to flip upwards relative to the upper frame 15. Flipping of the first load-bearing part 11 is achieved by moving using the first limiting mechanism 14 as a radius. A length of the first limiting mechanism 14 and connection positions of the two ends of the first limiting mechanism 14 are designed according to an angle by which the first load-bearing part 11 is to be flipped. Moreover, with cooperation of the first sliding mechanism 13, the first limiting mechanism 14 pulls the first load-bearing part 11 to move towards the head portion 101 of the upper frame 15. While the first sliding mechanism 13 moves towards a head portion 101 of the bed body, the first sliding mechanism 13 also drives the second sliding mechanism 23 which is pivotably connected to the first sliding mechanism 13 to move towards the head portion 101 of the bed body. The second load-bearing part 21 follows the second sliding mechanism 23 and moves towards the head portion 101 of the bed body, so that a relative distance between either of the first load-bearing part 11 and the second load-bearing part 21 and the head portion 101 of the upper frame 15 basically remains unchanged during the flipping process to realize a function that the head portion 101 of the first load-bearing part 11 is close to the wall and avoid that the head portion 101 of the bed body approaches a tail portion 201 after the flipping, so as to provide the user a better visual distance.

When the second flipping mechanism 22 operates, the second flipping mechanism 22 drives the second load-bearing part 21 in whole or in part to flip upwards relative to the lower frame 25. Flipping of the second load-bearing part 21 is achieved by moving using a length of the second limiting mechanism 24 as a radius. A length of the second limiting mechanism 24 may be designed according to actual needs, and the second limiting mechanism 24 limits a motion trail and a height of the flipping of the second load-bearing part 21. When the first sliding mechanism 13 pulls the second sliding mechanism 23 to move horizontally, the second limiting mechanism 24 also moves horizontally therewith to maintain a limitation on the motion trail and the height of the flipping of the second load-bearing part 21, which helps to keep a flipping form of the second load-bearing part 21 so as to provide a more comfortable sleeping posture to the user.

Further, as shown in FIG. 2, the first load-bearing part 11 includes a first load-bearing component 111 and a second load-bearing component 112. The second load-bearing part 21 includes a third load-bearing component 211, a fourth load-bearing component 212, and a fifth load-bearing component 213. The first load-bearing component 111 and the second load-bearing component 112 are pivotably connected at a junction. The third load-bearing component 211, the fourth load-bearing component 212, and the fifth load-bearing component 213 are successively pivotably connected at junctions.

The first load-bearing component 111 and the second load-bearing component 112 are pivotably connected at a junction, and the third load-bearing component 211, the fourth load-bearing component 212, and the fifth load-bearing component 213 are successively pivotably connected at junctions. By adjusting connection relationships between either of the first flipping mechanism 12 and the second flipping mechanism 22 and different load-bearing parts, diversified bed surface deformations can be realized, so as to meet different needs.

Preferably, the first flipping mechanism 12 drives the first load-bearing component 111 to flip upwards relative to the upper frame 15. The second flipping mechanism 22 drives the fourth load-bearing component 212 to flip upwards relative to the lower frame 25. When the fourth load-bearing component 212 flips, the fourth load-bearing component 212 drives the fifth load-bearing component 213 to flip together. The first load-bearing component is mainly used to support a head portion 101 and a back portion of the human body. The second load-bearing component 112 and the third load-bearing component 211 are mainly used to support an arm portion. The fourth load-bearing component 212 and the fifth load-bearing component 213 are mainly used to support a leg portion of the human body and cooperate with bending of the leg portion of the human body, so as to provide a more comfortable experience to the user.

Figure 4:
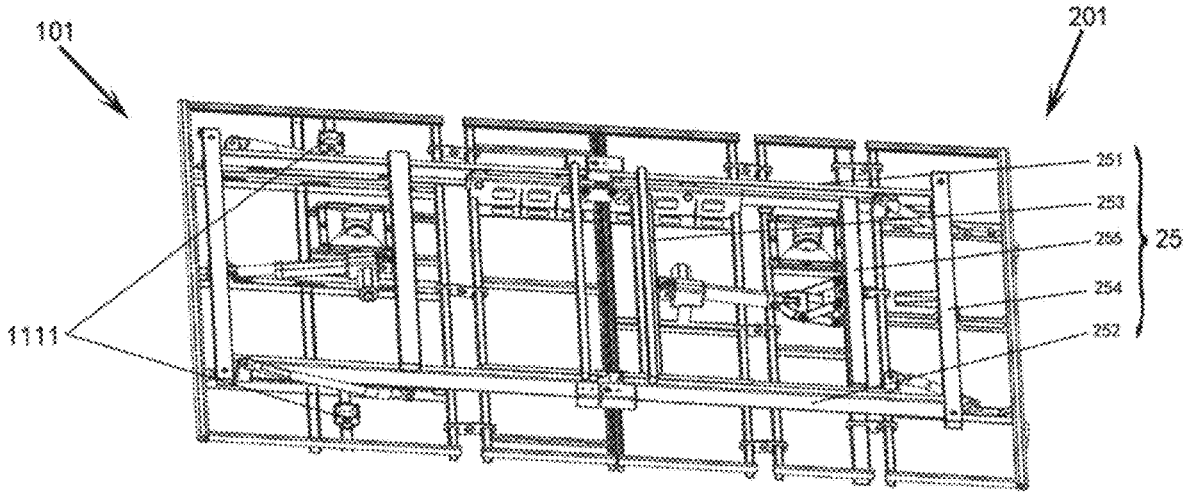
FIG. 4 is a second bottom view of a foldable electric bed according to an embodiment of the disclosure.

Further, FIG. 4 is a second bottom view of a foldable electric bed according to an embodiment of the disclosure. As shown in FIG. 3 and FIG. 4, the upper frame 15 includes a first supporting element 151, a second supporting element 152, a third supporting element 153, a fourth supporting element 154, and a fifth supporting element 155. The lower frame 25 includes a sixth supporting element 251, a seventh supporting element 252, an eighth supporting element 253, a ninth supporting element 254, and a tenth supporting element 255. Herein, the first supporting element 151 and the second supporting element 152 are parallel. The third supporting element 153, the fourth supporting element 154, and the fifth supporting element 155 are parallel to one another. Two ends of the first supporting element 151 and two ends of the second supporting element 152 are respectively perpendicular to and connected to two ends of the third supporting element 153 and two ends of the fourth supporting element 154. Two ends of the fifth supporting element 155 are respectively perpendicular to and connected to the first supporting element 151 and the second supporting element 152, and the fifth supporting element 155 is located below the first load-bearing component 111. The sixth supporting element 251 and the seventh supporting element 252 are parallel. The eighth supporting element 253, the ninth supporting element 254, and the tenth supporting element 255 are parallel to one another. Two ends of the sixth supporting element 251 and two ends of the seventh supporting element 252 are respectively perpendicular to and connected to two ends of the eighth supporting element 253 and two ends of the ninth supporting element 254. Two ends of the tenth supporting element 255 are respectively perpendicular to and connected to the sixth supporting element 251 and the seventh supporting element 252, and the tenth supporting element 255 is located below the fourth load-bearing component 212.

Preferably, an elongated strip-shaped metal element is used as the first supporting element to the tenth supporting element 255. When strength is sufficient, a hollow metal tube may also be selected, and it is certain that a plastic element and the like which meet strength requirements may also be used, so as to reduce the weight of the bed body, provide convenience for transportation, and save transportation costs.

Further, as shown in FIG. 3, the first sliding mechanism 13 includes a first rail, a first pulley set 131, and a first pulley seat 132. Herein, the first rail is disposed at an inner side wall of the first supporting element 151 and an inner side wall of the second supporting element 152. The first pulley set 131 and the first pulley seat 132 are pivotably connected. The first pulley seat 132 and the second supporting element are fixedly connected. The first pulley set 131 is slidable on the first rail. The second sliding mechanism 23 includes a second rail, a second pulley set 231, a second pulley seat 232, a third rail 233, a third pulley set, and a third pulley seat 234. Herein, the second rail is disposed at an inner side wall of the sixth supporting element 251 and an inner side wall of the seventh supporting element 252. The second pulley set 231 and the second pulley seat 232 are pivotably connected. The second pulley seat 232 and the third supporting element are fixedly connected. The second pulley set 231 is slidable on the second rail. The third rail is perpendicular to and fixedly connected to a middle portion of the ninth supporting element 254, and extends towards the tenth supporting element. A top surface of the third rail is flush with a top surface of the lower frame 25. The third pulley set and the third pulley seat 234 are pivotably connected. The third pulley seat 234 and the fifth supporting element are fixedly connected. The third pulley set is slidable on the second rail. The first pulley seat 132 and the second pulley seat 232 are pivotably connected at a junction of the upper frame 15 and the lower frame 25.

A length of each of the first rail, the second rail, and the third rail 233 is set according to a distance for which a pulley set needs to slide, so as to cooperate with various deformations and limit sliding. The first rail, the first pulley set 131, and the first pulley seat 132 cooperate, so that the first load-bearing component 111 and the second load-bearing component 112 slide on the upper frame 15. The second rail, the second pulley set 231, the second pulley seat 232, the third rail 233, the third pulley set, and the third pulley seat 234 cooperate in groups, so that the third load-bearing component 211, the fourth load-bearing component 212, and the fifth load-bearing component 213 slide on the lower frame 25. Especially for the third rail 233, the third pulley set, and the third pulley seat 234, if the pulley is mounted below the top surface of the lower frame 25, when a tail portion 201 of the fifth load-bearing component 213 goes beyond an edge of the lower frame 25, the fifth load-bearing component 213 may interfere with the lower frame 25 during moving, which is not helpful for realizing the function that the bed body is close to the wall. The function that the bed body is close to the wall is realized by cooperation of multiple sliding mechanism, and a horizontal movement height of the fifth load-bearing component is higher than the lower frame 25 by additionally disposing the third rail, so that the load-bearing component that goes beyond the edge of the lower frame 25 may also smoothly move horizontally, which ensures realization of the function that the bed body is close to the wall.

Further, as shown in FIG. 3 and FIG. 4, the second sliding mechanism 23 further includes a fourth rail, a fourth pulley set 235, and a fourth pulley seat 236. Herein, the fourth rail is disposed at an inner side wall of the sixth supporting element 251 and an inner side wall of the seventh supporting element 252. The fourth pulley set 235 and the fourth pulley seat 236 are pivotably connected. The fourth pulley seat 236 is fixedly connected to a head portion 101 of the fifth supporting element. The fourth pulley set 235 is slidable on the fourth rail. Two ends of the second limiting mechanism 24 are respectively pivotably connected to the fourth pulley seat 236 and the fifth load-bearing component 213.

When the second flipping mechanism 22 drives the fourth load-bearing component 212 to flip upwards from a tail portion 201 and relative to the lower frame 25, the fifth load-bearing component not only follows the flipping but also may be lifted in whole with cooperation of the second limiting mechanism 24, so as to provide better support to a foot portion of the user and make the user further relax. When the fifth load-bearing component 213 moves towards a head portion 101, with cooperation of the fourth rail, the fourth pulley set 235, and the fourth pulley seat 236, the second limiting mechanism 24 also moves horizontally and does not limit the horizontal movement of the fifth load-bearing component 213, so as to ensure that a load-bearing part of the bed body approaches the head portion 101.

Further, as shown in FIG. 3 and FIG. 4, two ends of the first flipping mechanism 12 are perpendicular to and pivotably connected to a head portion 101 of the first load-bearing component 111 and a middle portion of the fifth supporting element 155 respectively. The second flipping mechanism 22 includes a driving motor 221 and a scissor-type bracket. Herein, one end of the driving motor 221 is perpendicular to and pivotably connected to a middle portion of the seventh supporting element 252. The scissor-type bracket includes a first supporting bracket 222 and a second supporting bracket 223. Two ends of the first supporting bracket 222 are respectively pivotably connected to a tail portion 201 of the fourth load-bearing component 212 and the other end of the driving motor 221. Two ends of the second supporting bracket 223 are respectively pivotably connected to a middle portion of the tenth supporting element 255 and a middle portion of the first supporting bracket 222.

When the driving motor 221 operates, the driving motor 221 drives the scissor-type bracket to approach the tenth supporting element 255. However, limited by the first supporting bracket 222 and the second supporting bracket 223, an angle between the first supporting bracket 222 and the second supporting bracket 223 can only be driven to increase by using a pivotable connection point between the first supporting bracket 222 and the second supporting bracket 223 as a rotation shaft, so as to drive the fourth load-bearing component 212 to flip upwards relative the lower frame 25 and drive the fifth load-bearing component 213 to flip. The scissor-type bracket is horizontally driven by the motor so as to realize flipping of the fourth supporting element and the fifth supporting element, so that less space is occupied in the vertical direction, which helps to reduce the thickness of the bed body.

Figure 5:
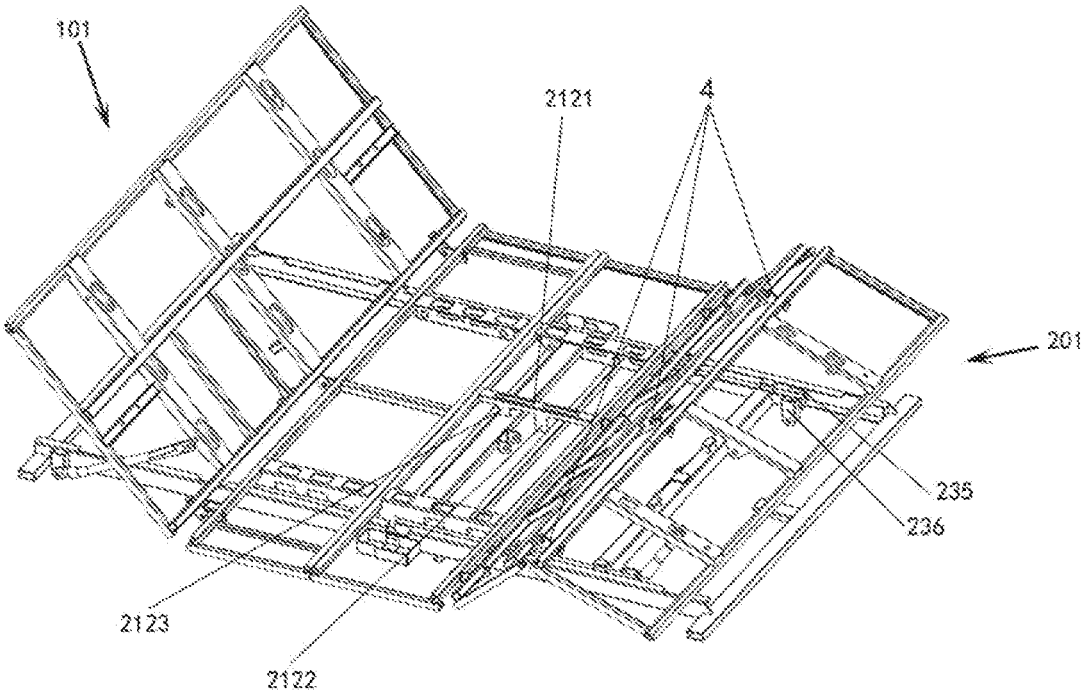
FIG. 5 is a foldable electric bed in a folding state according to an embodiment of the disclosure.

Further, FIG. 5 is a foldable electric bed in a folding state according to an embodiment of the disclosure. As shown in FIG. 5, a thickness at a center of a pivotable junction 4 of the fourth load-bearing component 212 and the fifth load-bearing component 213 is less than a thickness at an extension thereof. The thickness at the extension of the pivotable junction 4 of the fourth load-bearing component 212 and the fifth load-bearing component 213 is less than a thickness of the fourth load-bearing component 212 and a thickness of the fifth load-bearing component 213.

When the fourth load-bearing component 212 and the fifth load-bearing component 213 flip upwards, if the thickness at the pivotable junction 4 is the same as the thickness of the fourth load-bearing component 212 or the fifth load-bearing component 213, a highest point of the pivotable junction 4 is lower than a transition arc of the fourth load-bearing component 212 and the fifth load-bearing component 213, and the pivotable junction 4 does not go into an interior of a mattress. However, if the highest point of the pivotable junction 4 goes beyond a transition radius of the fourth load-bearing component 212 and the fifth load-bearing component 213, a top of the pivotable junction 4 would go into the interior of the mattress, which causes abrasion and scratches to the mattress. The transition radius of the fourth load-bearing component 212 and the fifth load-bearing component 213 is reduced by controlling the thickness of the pivotable junction 4 between the fourth load-bearing component 212 and the fifth load-bearing component 213, so as to avoid abrasion and scratches to the mattress as much as possible.

Further, as shown in FIG. 5, the fourth load-bearing component 212 further includes a reinforcing rod 2121, a fool-proofing element 2122, and a shock absorbing element 2123. Herein, the reinforcing rod 2121 is disposed on the third load-bearing component 211, and the fool-proofing element 2122 and the shock absorbing element 2123 are both disposed on the reinforcing rod 2121. The fool-proofing element 2122 is located right above the driving motor 221 and extends towards the driving motor 221. The shock absorbing element 2123 is located right above the eighth supporting element 253 and extends to a top of the eighth supporting element 253.

The fool-proofing element 2122 extends towards a mounting position of the driving motor 221 and limits the mounting position of the driving motor 221 in combination with a structure of the driving motor 221. If an installation person performs mounting reversely, mounting cannot be performed successfully. The fool-proofing element 2122 reminds the installation person of adjusting a placement position of the driving motor 221, which helps to prevent interference between the motor and the frame caused by reverse mounting of the motor.

The shock absorbing element 2123 extends to a top of the eighth supporting element 253 and forms support, which improves supporting strength of the third load-bearing component 211 and meanwhile also reinforces support of the fourth load-bearing component 212 and the fifth load-bearing component 213, thereby stabilizing a load-bearing surface formed by the third load-bearing component 211, the fourth load-bearing component 212 and the fifth load-bearing component 213. Besides, when flipping ends and the electric bed returns to a flat and unfolded state, there is certain shock when the third load-bearing component 211 descends and is near the eighth supporting element 253. By using the shock absorbing element 2123 to release a part of the shock in advance, it can be avoided that all load-bearing parts bring shock to the flipping mechanisms, thereby prolonging the service life of the bed body.

Further, as shown in FIG. 4, the first load-bearing component 111 further includes a multifunction socket 1111. Herein, the multifunction socket 1111 is disposed on a lower surface of the first load-bearing component 111.

An ordinary power socket, a two-hole USB socket and the like may be selected as the multifunction socket 1111. The multifunction socket 1111 and the first load-bearing component 111 rises and descends synchronously, so that a circumstance that a charging cable is strained or not long enough because of rising of a bed board does not occur and that the multifunction socket is convenient for the user to use.

After considering the description and practicing the invention disclosed herein, those skilled in the art will easily conceive of other embodiments of the disclosure. The application intends to cover any variants, uses, or adaptive changes of the disclosure, and these variants, uses, or adaptive changes of the disclosure follow general principles of the disclosure and include common knowledge or common technical means in the technical field that are not disclosed in the disclosure. The description and the embodiments are only regarded as exemplary, and the true scope and spirit of the disclosure is defined by the following claims.

It should be understood that, the disclosure is not limited to the precise structures that have been described above and illustrated in the drawings, and various modifications and changes can be made without departing from the scope of the disclosure.

The invention claimed is:

1. A foldable electric bed, wherein the foldable electric bed comprises an upper bed body, a lower bed body, and a split-type fixing part, wherein, two ends of the split-type fixing part are fixedly connected to an outer wall of the upper bed body and an outer wall of the lower bed body on the same side respectively, and the upper bed body is foldable at the split-type fixing part relative to the lower bed body; and the split-type fixing part comprises a first fixing piece and a second fixing piece, wherein the first fixing piece and the second fixing piece are detachably and fixedly connected, the first fixing piece being disposed on the outer wall of the upper bed body, the second fixing piece being disposed on the outer wall of the lower bed body;

the upper bed body comprises a first load-bearing part, a first flipping mechanism, a first sliding mechanism, a first limiting mechanism, and an upper frame; and the lower bed body comprises a second load-bearing part, a second flipping mechanism, a second sliding mechanism, a second limiting mechanism, and a lower frame, wherein, the first load-bearing part is disposed on a top of the upper frame; the first flipping mechanism and the first sliding mechanism are both located between the first load-bearing part and the upper frame; two ends of the first flipping mechanism are respectively pivotably connected to a head portion of the first load-bearing part and the upper frame; the first sliding mechanism is fixedly connected to the first load-bearing part and a tail portion of the upper frame so that the first load-bearing part is slidable relative to the upper frame; and two ends of the first limiting mechanism are respectively pivotably connected to the first load-bearing part and a head portion of the upper frame;

the second load-bearing part is disposed on a top of the lower frame; the second flipping mechanism and the second sliding mechanism are both located between the second load-bearing part and the lower frame; two ends of the second flipping mechanism are respectively pivotably connected to the second load-bearing part and a head portion of the lower frame; the second sliding mechanism are fixedly connected to the second load-bearing part and the lower frame respectively so that the second load-bearing part is slidable relative to the lower frame; and two ends of the second limiting mechanism are respectively pivotably connected to a tail portion of the first load-bearing part and the second sliding mechanism; and the first sliding mechanism and the second sliding mechanism are pivotably connected at a junction of the upper bed body and the lower bed body;

the first load-bearing part comprises a first load-bearing component and a second load-bearing component; and the second load-bearing part comprises a third load-bearing component, a fourth load-bearing component, and a fifth load-bearing component, wherein the first load-bearing component and the second load-bearing component are pivotably connected at a junction; and the third load-bearing component, the fourth load-bearing component, and the fifth load-bearing component are successively pivotably connected at junctions;

the upper frame comprises a first supporting element, a second supporting element, a third supporting element, a fourth supporting element, and a fifth supporting element; and the lower frame comprises a sixth supporting element, a seventh supporting element, an eighth supporting element, a ninth supporting element, and a tenth supporting element, wherein, the first supporting element and the second supporting element are parallel; the third supporting element, the fourth supporting element, and the fifth supporting element are parallel to one another; two ends of the first supporting element and two ends of the second supporting element are respectively perpendicular to and connected to two ends of the third supporting element and two ends of the fourth supporting element; and two ends of the fifth supporting element are respectively perpendicular to and connected to the first supporting element and the second supporting element, and the fifth supporting element is located below the first load-bearing component; and the sixth supporting element and the seventh supporting element are parallel; the eighth supporting element, the ninth supporting element, and the tenth supporting element are parallel to one another; two ends of the sixth supporting element and two ends of the seventh supporting element are respectively perpendicular to and connected to two ends of the eighth supporting element and two ends of the ninth supporting element; and two ends of the tenth supporting element are respectively perpendicular to and connected to the sixth supporting element and the seventh supporting element, and the tenth supporting element is located below the fourth load-bearing component;

the first sliding mechanism comprises a first rail, a first pulley set, and a first pulley seat, wherein, the first rail is disposed at either an inner side wall of the first supporting element or an inner side wall of the second supporting element; the first pulley set and the first pulley seat are pivotably connected; the first pulley seat and the second supporting element are fixedly connected; and the first pulley set is slidable on the first rail; and the second sliding mechanism comprises a second rail, a second pulley set, a second pulley seat, a third rail, a third pulley set, and a third pulley seat, wherein, the second rail is disposed at either an inner side wall of the sixth supporting element or an inner side wall of the seventh supporting element; the second pulley set and the second pulley seat are pivotably connected; the second pulley seat and the third supporting element are fixedly connected; and the second pulley set is slidable on the second rail;

the third rail is perpendicular to and fixedly connected to a middle portion of the ninth supporting element and extends towards the tenth supporting element; a top surface of the third rail is flush with a top surface of the lower frame; the third pulley set and the third pulley seat are pivotably connected; the third pulley seat and the fifth supporting element are fixedly connected; and the third pulley set is slidable on the second rail; and the first pulley seat and the second pulley seat are pivotably connected at a junction of the upper frame and the lower frame.

2. The foldable electric bed according to claim 1, wherein the second sliding mechanism further comprises a fourth rail, a fourth pulley set, and a fourth pulley seat, wherein, the fourth rail is disposed at an inner side wall of the sixth supporting element and an inner side wall of the seventh supporting element; the fourth pulley set and the fourth pulley seat are pivotably connected; the fourth pulley seat is fixedly connected to a head portion of the fifth supporting element, and the fourth pulley set is slidable on the fourth rail; and two ends of the second limiting mechanism are respectively pivotably connected to the fourth pulley seat and the fifth load-bearing component.

3. The foldable electric bed according to claim 1, wherein two ends of the first flipping mechanism are respectively perpendicular to and pivotably connected to a head portion of the first load-bearing part and a middle portion of the fifth supporting element, and the second flipping mechanism comprises a driving motor and a scissor-type bracket, wherein, one end of the driving motor is perpendicular to and pivotably connected to a middle portion of the seventh supporting element; and the scissor-type bracket comprises a first supporting bracket and a second supporting bracket, wherein, two ends of the first supporting bracket are respectively pivotably connected to a tail portion of the fourth load-bearing component and the other end of the driving motor; and two ends of the second supporting bracket are respectively pivotably connected to a middle portion of the tenth supporting element and a middle portion of the first supporting bracket.

4. The foldable electric bed according to claim 3, wherein a thickness at a center of a pivotable junction of the fourth load-bearing component and the fifth load-bearing component is less than a thickness at an extension thereof, and the thickness at the extension of the pivotable junction of the fourth load-bearing component and the fifth load-bearing component is less than a thickness of the fourth load-bearing component and a thickness of the fifth load-bearing component.

5. The foldable electric bed according to claim 3, wherein the fourth load-bearing component further comprises a reinforcing rod, a fool-proofing element, and a shock absorbing element, wherein, the reinforcing rod is disposed on the third load-bearing component; the fool-proofing element and the shock absorbing element are both disposed on the reinforcing rod; the fool-proofing element is located right above the driving motor and extends towards the driving motor; and the shock absorbing element is located right above the eighth supporting element and extends to a top of the eighth supporting element.

6. The foldable electric bed according to claim 5, wherein the first load-bearing component further comprises a multifunction socket, wherein, the multifunction socket is disposed on a lower surface of the first load-bearing component.

* * * * *